US007007562B2

(12) United States Patent
Judic

(10) Patent No.: US 7,007,562 B2
(45) Date of Patent: Mar. 7, 2006

(54) LABORATORY PIPETTE COMPRISING A BRAID OF SYNTHETIC FIBER THREADS INTERLACED WITH A COLOR CORRESPONDING TO AT LEAST ONE CHARACTERISTIC OF THE PIPETTE

(75) Inventor: Viviane Judic, Le Pignerol (FR)

(73) Assignee: Articles de Laboratoire de Precision, Chorges (FR)

( * ) Notice: Subject to any disclaimer, the term of this patent is extended or adjusted under 35 U.S.C. 154(b) by 5 days.

(21) Appl. No.: 10/685,439

(22) Filed: Oct. 16, 2003

(65) Prior Publication Data

US 2004/0123680 A1 Jul. 1, 2004

(30) Foreign Application Priority Data

Oct. 16, 2002 (FR) ..... 02 12850

(51) Int. Cl.
*B01L 3/02* (2006.01)

(52) U.S. Cl. ..... 73/864.01; 422/922; 422/100

(58) Field of Classification Search ..... 73/864.01, 73/864.02, 864.03, 864.11, 864.12; 422/100, 422/101

See application file for complete search history.

(56) References Cited

U.S. PATENT DOCUMENTS 4,523,366 A * 6/1985 Lodge et al. ..... 29/564.6
5,364,595 A * 11/1994 Smith ..... 422/100
5,563,356 A 10/1996 Mussi et al.
5,851,491 A * 12/1998 Moulton ..... 422/101
6,045,757 A * 4/2000 Moriarty et al. ..... 422/100
2001/0041913 A1 11/2001 Cragg et al.

FOREIGN PATENT DOCUMENTS

| | | |
|---|---|---|
| DE | 4410633 | 3/1994 |
| EP | 0261023 | 9/1987 |
| WO | 96/17673 | 6/1996 |

OTHER PUBLICATIONS

Translation of abstract EP 261023.*

* cited by examiner

*Primary Examiner*—Hezron Williams
*Assistant Examiner*—Nashmiya Fayyaz
(74) *Attorney, Agent, or Firm*—Clark & Brody

(57) ABSTRACT

Laboratory pipette composed particularly of a transparent tube comprising one end for sampling a liquid and one suction end into which a piece of fibrous material is inserted with a color corresponding to at least one characteristic of the pipette and particularly to its nominal volume, characterized in that the piece of fibrous material is in the form of a braid of interlaced threads of synthetic fibers, the said braid being folded such that the fold thus formed is located towards the inside of the pipette, and a method of identifying at least one characteristic of the pipette.

27 Claims, 2 Drawing Sheets

| Nominal volume of the pipette | 1 | 2 | 5 | 10 | 25 |
|---|---|---|---|---|---|
| colour of the braid | yellow | green | blue | orange | red |
| Diameter of the braid (mm) | 2 +/- 0.2 | 3 +/- 0.2 | 3 +/- 0.2 | 5 +/- 0.2 | 5 +/- 0.2 |
| Number of threads of the braid | 4 | 8 | 8 | 16 | 16 |
| Pick count number of stitches/ forward-return loops | 2 | 4 | 5 | 4 | 4 |
| Numbering of the thread (decitex) | 2100 +/- 55 | 2100 +/- 55 | 2100 +/- 55 | 2100 +/- 55 | 2100 +/- 55 |
| Weight of the braid per metre (g/m) | 0.97 +/- 0.1 | 1.97 +/- 0.1 | 2.23 +/- 0.1 | 4.02 +/- 0.1 | 4.02 +/- 0.1 |

LABORATORY PIPETTE COMPRISING A BRAID OF SYNTHETIC FIBER THREADS INTERLACED WITH A COLOR CORRESPONDING TO AT LEAST ONE CHARACTERISTIC OF THE PIPETTE

BACKGROUND OF THE INVENTION

The technical domain of the invention relates to laboratory instruments, particularly laboratory pipettes, and specifically single-use disposable pipettes used in biology laboratories, medical analyses, serology, immunology, microbiology and industrial laboratories, etc.

It is known that different volume pipettes are not very different from each other. Thus, when many pipettes with different volumes are mixed together, it is very difficult to distinguish between them, particularly when a large number of manipulations is necessary, or if the manipulations have to be made quickly.

Different proposals according to prior art are intended to supply laboratory pipettes that can be quickly and unambiguously identified in terms of their main characteristic and particularly their nominal volume. It is then possible to immediately choose a pipette with a given characteristic among a group of pipettes with various characteristics. European patent EP 261 023 proposes a laboratory pipette of the type comprising characterisation means such that the user can immediately identify a maximum or nominal volume of the pipette without any possible error, characterised in that the characterisation means comprise at least one piece of coloured material in a colour corresponding to the maximum or nominal volume of the pipette and that is inserted in the suction end of the pipette. The piece of coloured material forms a reliable characterisation means with a very low cost price visible to the user from the outside under all circumstances, while remaining unaffected by any external aggression. In general, a colour code is used complying with the international standard with a bi-univocal relation with the maximum or nominal volumes of frequently used pipettes. For example, this standard specifies that 1 ml pipettes are characterised by yellow, 2 ml pipettes by green, 5 ml pipettes by blue, 10 ml pipettes by orange, 25 ml pipettes by red, etc.

BRIEF SUMMARY OF THE INVENTION

The piece of coloured material used is preferably made of a fibrous or hydrophobic cellular material, particularly made of wood viscose, cellulose, cotton or other. The dimensions of the piece of coloured material are adapted as a function of the diameter of the suction end of the pipette, so that it can be inserted and fixed in place by itself simply due to contact with the walls. In practice, it has been found that a coloured wood viscose or cotton pad tends to wear or fluff and that elementary fibres can then fall into the liquid being sucked in. Therefore, it would be desirable to eliminate these risks of contamination.

Furthermore, the fibrous pads used are in the form of small cylinders of material with a diameter with some irregularities. Large variations in the diameter of the fibrous piece influence the pouring rate of the pipeted liquid obtained.

In this context, the purpose of this invention is an improvement to previously known laboratory pipettes, since these pipettes need to have the properties mentioned above and also to guarantee that there is no risk of the liquid to be pipeted being contaminated.

Another purpose of the invention is to provide pipettes provided with a piece of fibrous material, also called a pad, for quickly identifying them, this pad having good cohesion after being put into place in the pipette and with a low tendency to fluffing. The pad used in this invention is also characterised by the good uniformity of its diameter and porosity to enable a uniform liquid flow.

The invention relates to a laboratory pipette composed particularly of a transparent tube comprising one end for sampling a liquid and one suction end into which a piece of fibrous material is inserted with a colour corresponding to at least one characteristic of the pipette and particularly to its nominal volume. The piece of fibrous material is in the form of a braid of interlaced threads of synthetic fibres, the said braid being folded such that the fold thus formed is located towards the inside of the pipette.

Another purpose of the invention is a method of identifying at least one characteristic, and particularly the nominal volume of a laboratory pipette composed specifically of a transparent tube comprising one end for sampling a liquid and one suction end including the insertion of a piece of fibrous material with a colour corresponding to the identifiable characteristic of the pipette. In the method according to the invention, the piece of fibrous material used is a braid of interlaced threads of synthetic fibres that are folded before insertion and are inserted in the suction end, such that the fold thus formed is located towards the inside of the pipette.

Various other characteristics will become clear from the description given below with reference to the attached drawings, which contain non-limitative examples showing embodiments of the purpose according to the invention.

BRIEF DESCRIPTION OF THE INVENTION

DETAILED DESCRIPTION OF THE INVENTION

Figures 1, 5:
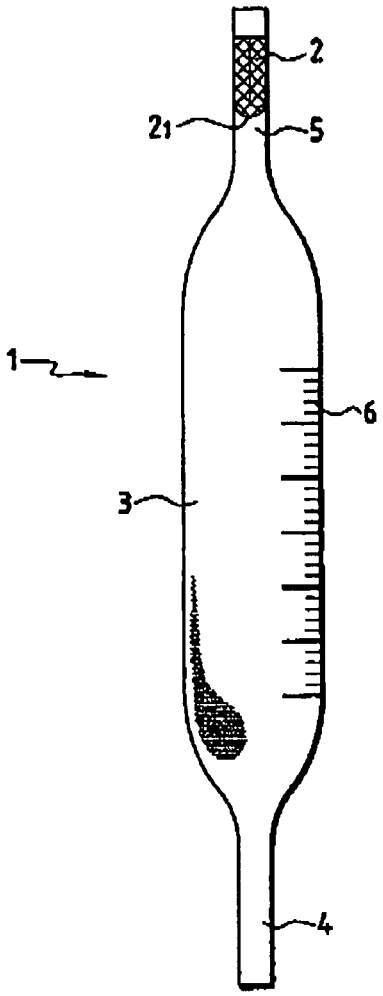
FIG. 1 shows an example of pipette conform with the invention.
FIG. 5 is a table containing different characteristics of braided pads used in pipettes according to the invention.

Apart from the piece of fibrous material used, the laboratory pipettes according to the invention have a conventional structure and operation, well known in prior art. FIG. 1 shows a non-limitative example of a pipette 1 according to the invention used to take a sample of a precise volume of a chemical or biological liquid. This type of tube 3 is extended at one of its ends into a tube with an identical or smaller diameter through which the liquid is either sampled or evacuated from the pipette, and this end is called the sampling end 4. At its other end, the tube 3 is extended into another tube for which the diameter is identical to or is less than the diameter of the tube 3 as illustrated in FIG. 1, depending on the volume of the pipette. This end, through which gases are sucked in or forced out, is called the suction end 5. The main part of the tube 3 comprises graduations 6 located outside the tube. As in laboratory pipettes described in prior art EP 261 023, a piece of fibrous material 2 is trapped on the inside of the suction end 5 of the pipette, preferably in the part remote from any graduation or text marking.

According to the invention, the fibrous piece 2 is composed of synthetic fibres, that are preferred to cotton or wood viscose type natural fibres that can cause cutting problems and can also influence the pipeting operation when the liquid to be pipeted accidentally comes into contact with the fibrous piece. In this case, fibres from an animal or natural origin introduce the risk that liquids to be sampled will be contaminated and therefore distort the analyses. The use of synthetic fibres limits deterioration to the sampled chemical and/or biological liquids, if they come into contact with or are brought near the fibrous piece 2 due to a manipulation mistake. Advantageously, a hydrophobic synthetic fibre pad will be used. Hydrophobic means a material that does not retain water. Thus, if too much liquid is pipeted or if liquid comes into contact with the pad, then firstly the pad will lose its characteristics, particularly for flow regulation, and secondly the liquid will not be retained in the pad thus modifying the pipeted volume.

Polypropylene fibres will preferably be used, since this material is resistant to chemicals and particularly to acid-base attacks. Advantageously, the fibrous piece used is a sterile material inert to the different biological or chemical liquids that have to be sampled, if these liquids come into contact with the said fibrous piece during the pipeting operation.

To avoid fibres from dropping into the liquid to be pipeted, the fibrous piece 2 according to the invention is inserted in a folded form. The fibrous piece in the form of a braid is folded on itself so as to form a fold extending transversely to the longitudinal axis of the braid. Advantageously, the braid is folded into two equal parts and is then inserted firstly making the fold $\mathbf{2}_1$ penetrate into the tube forming the end 5. Thus, the fold $\mathbf{2}_1$ formed is located not at the open end of the suction end 5 but rather at the end of the main part of the tube 3. Firstly, with this type of folding it is possible to obtain a clean cut in the direction of the liquid, this clean cut corresponding to fold $\mathbf{2}_1$ shown in FIG. 2. And secondly, this folding means that a spring effect can be obtained reinforcing the extent to which the fibrous piece 2 is held in place inside the suction end 5.

According to another essential characteristic of the invention, the fibrous piece is in the form of a braid.

A braid is made by an interlacing of at least three threads of synthetic fibres. Each thread is composed of many filaments grouped together, and the filaments may be defined as very small diameter threads. For example, each thread contains 128 filaments. Depending on the volume of the pipette, the braid may for example be composed of 4, 8 or 16 interlaced threads. Textured threads may be used. The characteristics of the braid must be chosen so that gases can pass between them so that the sampled liquid can be drawn in or forced out. Consequently, the braided fibrous piece must not form a hermetic cap for the laboratory pipette. Braiding is chosen as a function of the required flow velocity of the liquid, and this braiding determines the porosity of the fibrous piece and therefore its capacity to allow air to pass through it which controls the resulting liquid flow velocity as a function of the pipette filling ratio.

Figure 2:
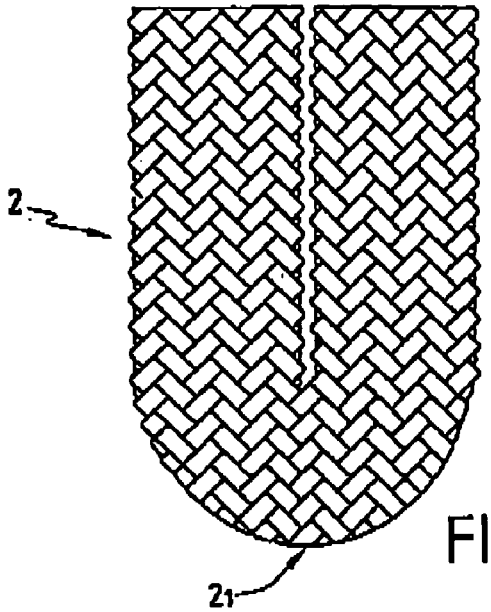
FIG. 2 shows an example of braided fibrous pads that can be used in pipettes according to the invention, at a larger scale.
Figure 3:
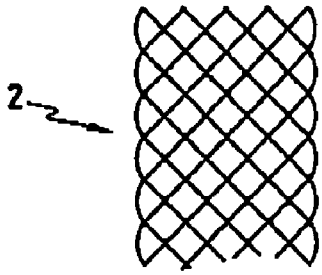
FIGS. 3 and 4 represent other appropriate braiding variants.
Figure 4:
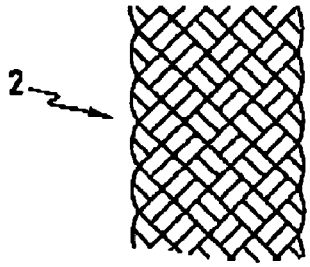

A "semi-occupied", "tandem occupied" or preferably "normal occupied" braid can be used as shown in FIGS. 3, 4 and 2 respectively. These braiding types are well known to an expert in the subject and are obtained using conventional braiding techniques. For example, braiders with 8 or 16 spindles could be used. Furthermore, the dimensions of the coloured pad 2 are varied depending on the diameter of the tube 3 at its suction end 5, such that the braid can be inserted and trapped by itself into this end simply by contact with the internal walls.

The number of threads present in the braid will depend on the diameter of the fibrous pad. For larger diameters, the braid will for example contain 16 threads and for example 4 threads for smaller diameters. The number of threads and the characteristics of the braid are chosen as a function of the nominal volume of the pipette, so as to obtain a similar flow velocity regardless of the volume of the pipette. An expert in the subject will be able to choose the characteristics of the braid as a function of the nominal volume of the pipette, and in particular the diameter of the suction end 5 and the flow velocity. These main characteristics are, in particular, the pick count (the number of stitches or forward-return loops per centimetre of braid), the numbering of the threads and the weight of the braid per linear metre. Advantageously, a braid will be used with a weight per linear metre of between 0.5 and 4.5 g/m. The table given in FIG. 5 shows characteristics of braids that can be used as a function of the nominal volume of the pipette, without being limitative.

The braid is coloured and each chosen colour corresponds to a value of a characteristic of the pipette and particularly its nominal volume. Therefore, the purpose of this invention is a method of identifying at least one characteristic, and particularly the nominal volume of a pipette. Moreover, the choice of the braiding diameter and density of the piece of fibrous material used provides a means of obtaining the required flow velocity for the liquid contained in the pipette as it is being used.

Said type of braid is coloured in-depth and therefore its colour is very homogeneous. Polypropylene fibres are particularly suitable for in-depth colouring, in other words done before the threads are produced. The type of colouring agent used is resistant to light, liquid and different sterilisation types. Different colouring agents can be used that bond to synthetic fibres perfectly and particularly to polypropylene.

As mentioned above, the fibrous piece 2 is inserted easily inside a laboratory pipette like that shown in FIG. 1, after having been folded. The assembly is then packaged and sterilised, for example using ethylene oxide followed by rinsing in air or by nuclear radiation.

What is claimed is:

1. Laboratory pipette comprising a transparent tube comprising one end for sampling a liquid and one suction end into which a piece of fibrous material is inserted with a color corresponding to at least one characteristic of the pipette, characterized in that the piece of fibrous material is in the form of a braid of interlaced threads of synthetic fibers, said braid being folded such that the fold thus formed is located towards the inside of the pipette.

2. Laboratory pipette according to claim 1, characterized in that a braiding occupancy of the braid is normal.

3. Laboratory pipette according to claim 1, characterized in that the braid is composed of 4, 8 or 16 interlaced threads.

4. Laboratory pipette according to claim 1, characterized in that the weight per linear meter of the braid is between 0.5 and 4.5 g/m.

5. Laboratory pipette according to claim 1, characterized in that the braid is made of polypropylene.

6. Method of identifying at least one characteristic of a laboratory pipette comprising a transparent tube comprising one end for sampling a liquid and one suction end into which a piece of fibrous material is inserted with a color corresponding to the characteristic of the pipette, characterized in that the piece of fibrous material used is in the form of a braid of interlaced threads of synthetic fibers, the method comprising folding the piece of fibrous material before insertion and then inserting the folded piece in the suction end, such that a fold thus formed is located towards the inside of the pipette.

7. Method according to claim 6, in which the flow velocity of the liquid to be sampled is regulated by choosing the number of threads in the braid and the weight of the braid per linear meter.

8. Method according to claim 6, characterized in that a braiding occupancy of the braid is normal.

9. Method according to claim 6, characterized in that a braid is composed of 4, 8 or 16 interlaced threads.

10. Method according to claim 6, characterized in that the weight per linear meter of the braid is between 0.5 and 4.5 g/m.

11. Method according to claim 6, characterized in that the braid is made of polypropylene.

12. Laboratory pipette according to claim 2, characterized in that the braid is composed of 4, 8 or 16 interlaced threads.

13. Laboratory pipette according to claim 2, characterized in that the weight per linear meter of the braid is between 0.5 and 4.5 g/m.

14. Laboratory pipette according to claim 3, characterized in that the weight per linear meter of the braid is between 0.5 and 4.5 g/m.

15. Laboratory pipette according to claim 2, characterized in that the braid is made of polypropylene.

16. Laboratory pipette according to claim 3, characterized in that the braid is made of polypropylene.

17. Laboratory pipette according to claim 4, characterized in that the braid is made of polypropylene.

18. Method according to claim 7, characterized in that the braiding occupancy of the braid is normal.

19. Method according to claim 7, characterized in that the braid is composed of 4, 8 or 16 interlaced threads.

20. Method according to claim 8, characterized in that the braid is composed of 4, 8 or 16 interlaced threads.

21. Method according to claim 7, characterized in that the weight per linear meter of the braid is between 0.5 and 4.5 g/m.

22. Method according to claim 8, characterized in that the weight per linear meter of the braid is between 0.5 and 4.5 g/m.

23. Method according to claim 9, characterized in that the weight per linear meter of the braid is between 0.5 and 4.5 g/m.

24. Method according to claim 7, characterized in that the braid is made of polypropylene.

25. Method according to claim 8, characterized in that the braid is made of polypropylene.

26. Method according to claim 9, characterized in that the braid is made of polypropylene.

27. Method according to claim 10, characterized in that the braid is made of polypropylene.

* * * * *